United States Patent [19]

Yagusic et al.

[11] 4,026,135

[45] May 31, 1977

[54] SPRING COILING MACHINE WITH AUXILIARY DRIVE AND CONTROL

[75] Inventors: George Joseph Yagusic, Litchfield; Bernard Pierre Lampietti, Goshen, both of Conn.

[73] Assignee: Torin Corporation, Torrington, Conn.

[22] Filed: May 14, 1975

[21] Appl. No.: 577,617

[52] U.S. Cl. ..... 72/14; 72/142

[51] Int. Cl.[2] ..... B21F 3/04

[58] Field of Search ..... 72/14, 15, 30, 135, 72/142; 140/103, 104

[56] References Cited

UNITED STATES PATENTS

| | | | |
|---|---|---|---|
| 873,430 | 12/1907 | Harter | 72/14 |
| 1,040,196 | 10/1912 | Harter | 72/14 |
| 2,135,729 | 11/1938 | Olgay | 72/14 |
| 2,831,524 | 4/1958 | Bache | 72/14 |
| 3,028,114 | 4/1962 | Asbeck | 72/14 |
| 3,192,748 | 7/1965 | Lange | 72/14 |

FOREIGN PATENTS OR APPLICATIONS

| | | | |
|---|---|---|---|
| 797,481 | 7/1958 | United Kingdom | 72/142 |

*Primary Examiner*—E. M. Combs
*Attorney, Agent, or Firm*—McCormick, Paulding & Huber

[57] ABSTRACT

A spring coiling machine with an auxiliary drive and control has a feed roll driving clutch with inputs from both a main machine drive and from the auxiliary drive. The main drive is set to rotate feed rolls to advance a length of wire an increment less than that required for a coil spring of a predetermined configuration and dimension. The final increment of wire feed is then accomplished by the auxiliary drive, the clutch acting to render the latter effective as main drive rotational velocity drops off. An optical sensor responsive to the position of a leading end portion of the wire in the spring being coiled thereafter signals the auxiliary drive control to terminate wire feed. A fast response servo motor is employed as an auxiliary drive and a precise termination of wire feed is thus achieved to provide for precise end positioning. The clutch employed is unidirectional and termination of auxiliary feed may be accomplished by terminating forward drive or by reversing the servo motor. A bistable device maintains an "on forward drive" signal pending receipt of an "off forward drive" or "reverse" signal, the latter being supplied by said optical position sensor. The "on" signal for the servo motor may be provided in either event by a cam shaft position sensor operable when a main drive actuated wire feeding operation is partially complete.

15 Claims, 4 Drawing Figures

SPRING COILING MACHINE WITH AUXILIARY DRIVE AND CONTROL

BACKGROUND OF THE INVENTION

In the manufacture of torsion type coil springs conventional front and/or rear tails can be formed with the aid of the auxiliary drive and a movable coiling tool of the usual type having active and inactive positions at the coiling station adjacent the line of wire feed. Front and rear tail "start" sensors are provided on the machine camshaft together with the aforementioned end position "start" sensor. Front and rear tail "stop" sensors and an "index" sensor respond to auxiliary drive and speed reducer output and bistable "on" – "off" devices are provided respectively for servo motor forward and reverse drive operation. In front tail formation, the corresponding camshaft sensor starts servo motor forward drive operation with the coiling tool inactive and the tail is formed with wire feeding operation terminated by the front tail "stop" sensor on the servo motor output. The main body of the spring may then be formed with the coiling tool in its active position and with the main and auxiliary drives operating sequentially as mentioned and with the front tail precisely positioned. Auxiliary drive operation with the coiling tool inactive may thereafter be initiated by the rear tail "start" sensor on the camshaft, terminated by the rear tail "stop" sensor on the servo motor output, and reverse drive indexing accomplished by the rear tail "stop" and the "index" sensor.

the present invention relates to the general type of spring coiling machine wherein wire is fed along a longitudinal path intermittently and is coiled during feeding by a coiling tool or abutment to form springs, cut-off occurring at the end of each wire feeding and coiling operation. While not necessarily so limited, the invention is particularly applicable to spring coiling machines of the type shown in:

- U.S. Pat. No. 2,119,002 issued May 31, 1938 to Bergevin and Nigro.
- U.S. Pat. No. 2,455,863 issued Dec. 7, 1948 to E. W. Halvorsen.
- U.S. Pat. No. 2,820,505 issued Jan. 21, 1958 to E. E. Franks et al.
- U.S. Pat. No. RE24,345 issued Aug. 20, 1957 to C. R. Bergevin.
- U.S. Pat. No. 2,902,079 issued Sept. 1, 1959 to Costello et al.
- U.S. Pat. No. 2,923,343 issued Feb. 2, 1960 to Franks.
- U.S. Pat. No. 2,925,115 issued Feb. 16, 1960 to Franks.
- U.S. Pat. No. 3,009,505 issued Nov. 21, 1961 to Franks.
- U.S. Pat. No. 3,068,927 issued Dec. 18, 1962 to Bergevin.
- U.S. Pat. No. 3,402,584 issued Sept. 24, 1968 to Cavagnero.
- U.S. Pat. No. 3,934,445 issued Jan. 27, 1976 to Lampietti.

More particularly, the invention relates to a spring coiling machine of the general type mentioned wherein provision is made for the precise control of wire end and/or tail position and for the forming of torsion type coil springs.

SUMMARY OF THE INVENTION

It is the general object of the present invention to provide a spring coiling machine which includes a fast response auxiliary drive and control which is operable selectively with the main machine drive and which greatly enhances the spring coiling machine capabilities in precise end and/or tail positioning and in the formation of torsion type coil springs.

DESCRIPTION OF PREFERRED EMBODIMENTS

Figure 1:
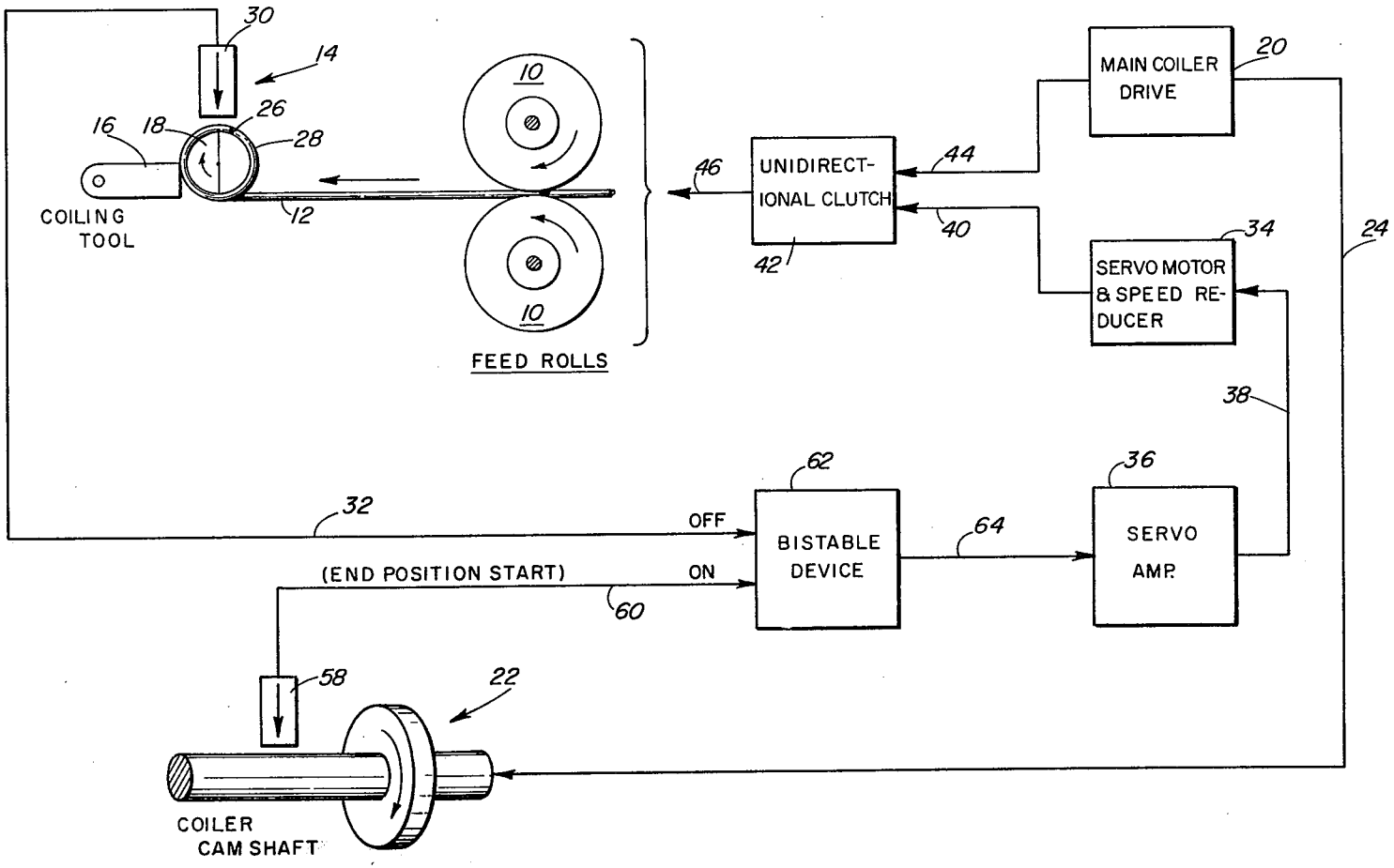
FIG. 1 is a schematic illustration of the spring coiling machine and auxiliary drive and control of the present invention with end positioning elements shown.

Referring particularly to FIG. 1, it will be observed that wire feeding rolls of the type usually found in spring coiling machines are illustrated generally at 10, 10. The feed rolls operate intermittently in the directions shown to advance spring wire 12 longitudinally leftwardly to a coiling station 14. At the coiling station, a coiling tool or abutment 16 is disposed approximately in the longitudinal line of wire feed, obstructs wire movement, and cooperates with an arbor 18 in a conventional manner to cause the wire to be coiled about the arbor into a coil of predetermined configuration and dimension. Pitch and cut-off tools, not shown, are also provided at the coiling station and when a predetermined length of wire has been advanced by the feed rolls and a spring thus formed, the cut-off tool is operated to sever the wire and the completed spring. Power is provided for driving the feed rolls from the main drive means at 20 and the various machine operating elements such as pitch, cut-off tools etc. are actuated in timed relationship with feed roll operation from a main camshaft in the spring coiler, indicated generally at 22. A main drive-camshaft connection is indicated generally by line 24.

All of the elements of construction and the operation mentioned above are conventional in the spring coiling art and reference may be had to one or more of the aforementioned patents for a more detailed description of such construction and operation. Both segment and clutch type spring coilers are well-known in the art although the patents mentioned above relate primarily to coilers of the segment type. The present invention is equally adaptable to either type of coiler. It will suffice here to point out that both types of spring coilers and the segment type in particular has earned a reputation for accuracy and durability and dependability in use over many years of service. In the manufacture of certain types of springs, however, and in particular where the angular relationship of the ends of the spring must be held constant from spring to spring, such known coilers have been found somewhat lacking. It is in fact a common practice when manufacturing springs which require an accurate end relationship, to provide for an auxiliary cutting operation wherein a portion of one end of the wire is severed subsequent to coiling to provide the necessary constant end position and relationship. This method of course entails a severe limitation upon production rates.

The control in a precise manner of end relationship or end position in accordance with the present invention involves the use of a sensor which reads precise "end position" of a leading end portion of a spring as it is coiled in a spring coiling machine. Thus, in FIG. 1, a leading end 26 of a spring 28 at coiling station 14 travels in a spiral generally clockwise path as the spring 28 is formed by the leftward longitudinal advancement of the wire 12. A sensor 30 at the coiling station reads the position of the leading end 28 of the wire and serves to precisely terminate wire feeding operation of the rolls 10,10 as will be described hereinbelow. The sensor 30 may vary widely in form and may be of the optical, proximity, touch or other type. As shown, a sensor 30 of the optical type and with an electrical pulse output is provided and is arranged to react to the passage of leading wire end 26 therebeneath through its vertical line of sight. The sensor may of course be provided with support means adjustable in both vertical and horizontal planes and through a 360° arc in a vertical plane in order to be capable of reading any desired angular position of the leading end 26 of the completed spring. Sensors of the optical type are presently preferred for relatively small wire diameters whereas proximity and touch type sensors may be preferred in the case of wire diameters ⅛ inch or greater.

In order to give effect to an electrical pulse signal in a line 32 extending from the sensor 30 and thereby to terminate precisely the operation of feed rolls 10,10 there is provided an auxiliary drive means having a response time sufficiently high to provide the desired accuracy of end positioning or end relationship. A fast response electrically operable servo motor comprising a D.C. motor with an associated power supply, control, and amplifier is employed. Various motors and control amplifiers may of course be utilized but it is presently preferred to employ and NC 104B "Solid State D.C. Servo Controller" manufactured by Control Systems Research, Inc., Pittsburgh, Pa. This unit can provide an rpm of approximately 1,000 and a reaction time to an electrical pulse signal from the sensor 30 such that the D.C. motor will cease to deliver torque in 50 milliseconds. The servo motor is schematically represented in FIG. 1 in a block 34 and the associated control and amplifier in a block 36, connection therebetween by line 38. The servo motor is reversible and there is associated therewith a speed reducing means which may comprise a worm gear arrangement and which is represented in block 34 with the servo motor. Speed reduction in the present embodiment of the invention is achieved from one thousand rpm to fifty rpm for transmission to the feed rolls 10,10.

The output from servo motor and speed reducer 34 which may of course take the form of a suitable drive shaft is represented by a line 40 extending to a unidirectional clutch 42. Similarly, the main drive 20, which may be of the segment or clutch type as indicated, has a drive shaft or other connection in common with the unidirectional clutch 42 as represented by a line 44. The clutch 42 in turn connects with conventional drive elements for the feed rolls 10,10 the former represented by line 46 and more fully illustrated and described in the aforementioned patents.

The unidirectional clutch 42 may vary in form and for purposes of illustrative example, it may be assumed that the said clutch comprises a form sprag, model: HPI No. 500. The clutch renders effective the higher of the two rotational velocity inputs from the lines 40,44 and is inoperable in a reverse drive direction. Thus, it is possible to have a first portion or increment of a wire feeding operation under the power of the main coiler drive 20 and a second or terminal portion or increment of the wire feeding operation under the influence of the servo motor and speed reducer 34, the clutch 42 serving to select automatically the higher rotational velocity input.

Figure 3:
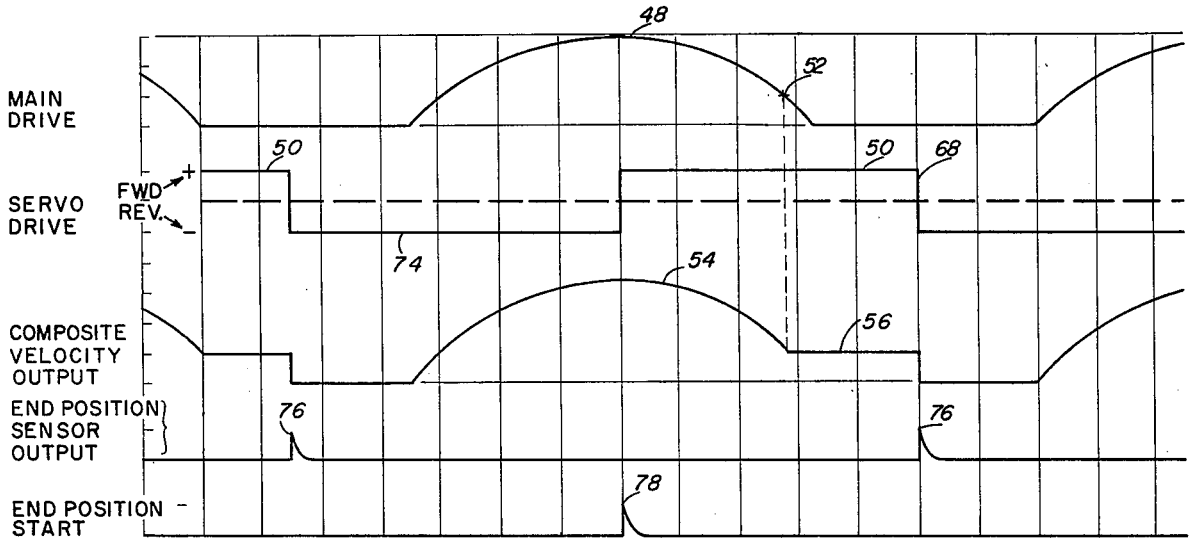
FIG. 3 is a timing diagram for end positioning operation of the machine and auxiliary drive.

Referring now to FIG. 3, it will be observed that the well-known harmonic velocity characteristic of a segment coiler is illustrated by the reference numeral 48. As shown, the main drive 20 is operable to advance a length of wire an increment less than that required for a coil spring of a predetermined configuration and dimension, the final or terminal increment being provided by the servo motor 34. The forward servo drive velocity of 50 rpm is illustrated at 50. With the servo drive operating as illustrated and with the drop off in velocity of the main drive 20 as illustrated by the curve 48, a cross-over point is reached at 52 such that the composite velocity has a characteristic 54,56. Thus, the wire feeding operation is partially achieved by the main coiler drive 20 at 54 and a latter portion thereof at 56 is achieved by the servo motor 34. The manner in which such selective or sequential operation of main and auxiliary drives is achieved and the advantages thereof are set forth hereinbelow.

In FIG. 1, the aforementioned coiler camshaft 22 has an associated sensor 58 which may vary in form but which is preferably of a fast response magnetic type well-known in the art. The sensor responds to the angular position of the shaft and has a pulse output signal transmitted by a line 60 which extends to a bistable device 62 in common with the aforementioned output line 32 from the sensor 30. The bistable device 62 may be of a conventional type and serves merely to provide a memory function such that an "on" signal for forward drive operation of the servo motor is maintained until an "off" signal is received from the line 32. Thus, the "on" signal transmitted from the bistable device 62 through line 64 to amplifier 36 and servo motor 34 causes the motor to start its forward drive operation at a pre-selected time during the machine cycle. Returning now to FIG. 3 it will be seen that the "on" signal for forward drive operation, pulse 78, is preferably transmitted to the amplifier and servo motor at approximately the mid-point of the main drive feed operation 48. Reference numeral 66 is employed to illustrate the commencement of the forward drive operation of the servo motor and termination thereof is illustrated at 68.

Termination of forward drive and wire feeding operationof the servo motor is accomplished in the auxiliary drive control by the sensor 30, its output line 32, the bistable device 62 and the amplifier 36. As mentioned, passage of the leading end of the wire 26 in a spring 28 beneath the sensor 30 and through its vertical line of sight results in the transmission of an "off" signal, pulse 76, through line 32 to the bistable device 62 in turn terminating the forward drive signal to the amplifier 36 and the servo motor 34. Thus, with the high rate of response of the servo motor as indicated above, precise termination of wire feeding operation of the rolls 10,10 is achieved with a high degree of repeatability and the desired accuracy of end position and end relationship is accomplished. As mentioned above, the unidirectional clutch 42 is inoperative to transmit a reverse drive to the feed rolls 10,10 and it will thus be apparent that the termination of the wire feeding operation may be accomplished either by merely terminating the servo motor forward drive operation or by reversing the same. In the latter instance, the bistable device 62 provides a negative voltage to the amplifier 36 and servo motor 34 and the latter merely remains in reverse as at 74 pending the next succeeding forward drive signal, pulse 78.

Figure 2:
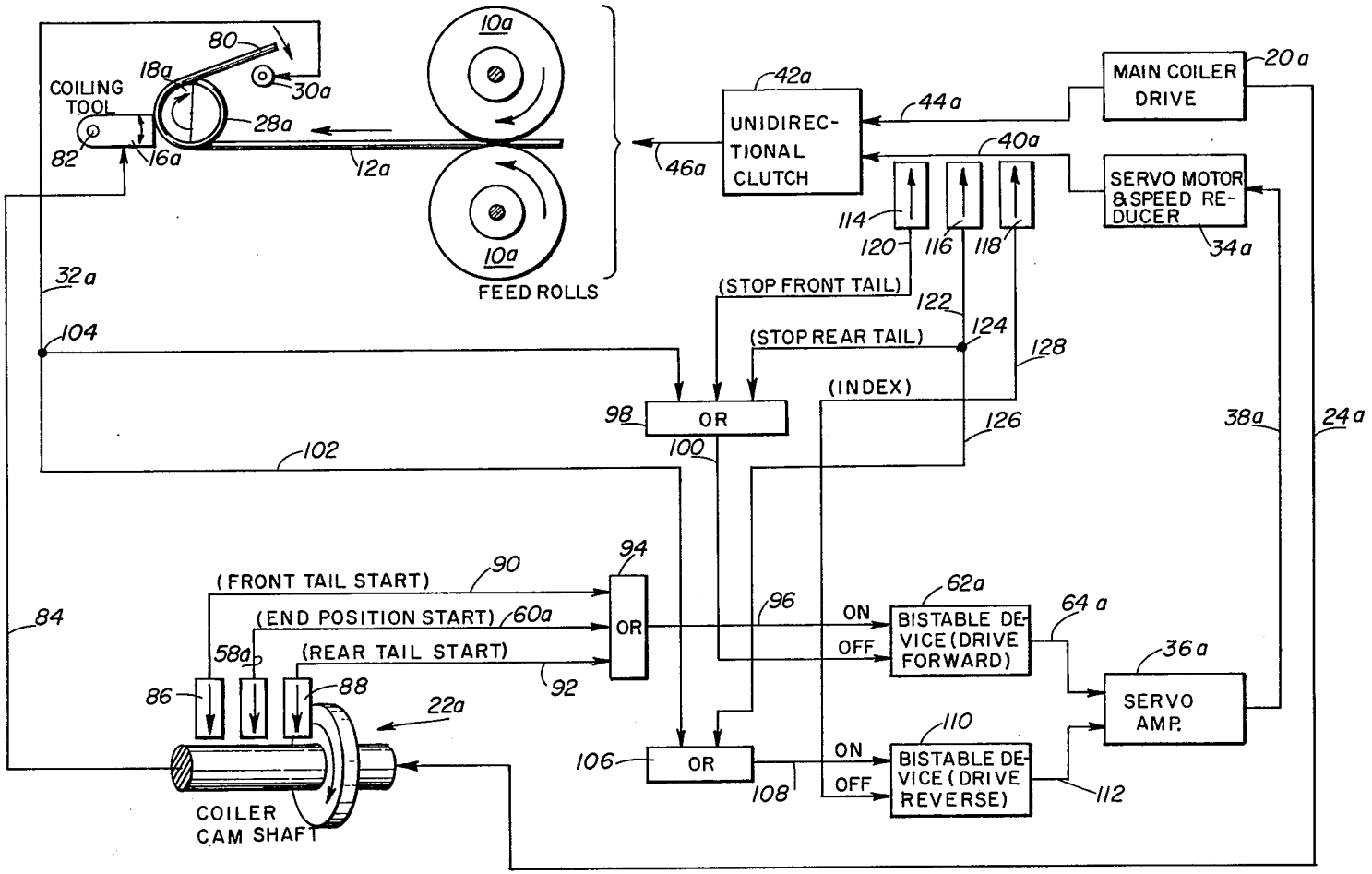
FIG. 2 is a schematic illustration of the spring coiling machine and auxiliary drive and control with tail positioning and torsion spring forming elements shown.

In FIG. 2 there is illustrated a spring coiling machine with auxiliary drive and control particularly adapted for the formation of torsion type coil springs. Such springs may have straight lengths of wire or "tails" which extend generally tangentially from the coil at one or both ends of the coil. Further, the angular relationship between such tails may be critical in certain applications. The present invention provides for precise positioning of a front or leading tail and thus for the precise angular relationship of front and rear tails as well as precise generation of tails of desired length. In the generation of tails of precise length it is necessary that an "index" function be provided so that wire feed rolls can be rotated to a particular angular position and a precise length of wire feed thus predetermined. In providing the "index" function it will be apparent that, in addition to the above mentioned forward and reverse drives, a "stop condition" of the servo motor is required and, accordingly, a second bistable device is required. Further, and as will be apparent hereinbelow, control over tail length is excersized by angularly displaced "index" and "stop rear tail" sensors operatively connected with the second bistable device.

All elements in FIG. 2 bearing reference numerals with an *a* suffix may be regarded as substantially identical with corresponding elements in FIG. 1. It should be noted, however, that sensor 30*a* has been repositioned so as to have a horizontal line of sight and to react to the angular or swinging passage thereby of a leading tail 80 on a torsion spring 28*a* formed at the coiling station 14*a*. That is, the tail 80 swings angularly downwardly and in a generally clockwise direction past the sensor as the spring is formed. In passage through the horizontal line of sight the sensor is actuated whereby to transmit wire feed and thus precisely to position the tail 80.

In the formation of torsion type coil springs a coiling tool 16*a* is movable between active and inactive positions respectively for the formation of the coil and tail portions of the springs. As illustrated schematically, the coiling tool 16*a* is swingable about a pivot 82 and is connected with the camshaft by means of a line 84. The line 84 represents mechanism operated from the camshaft and which swings the coiling tool between active and inactive positions in suitable timed relationship with remaining machine elements. Such mechanism is conventional and reference may be had to above mentioned U.S. Pat. No. 2,820,505 in particular for a full description of construction and operation. The auxiliary drive and control of the present invention may be employed for forming a single tail or for forming both front and rear tails and one or more of such tails may be formed by the mechanism shown in said patent. Thus, a combination of a leading or front tail formed by the patented mechanism and a rear tail formed by the device of the present invention is possible as well as various other combinations.

Referring particularly to the camshaft 22*a*, it will be observed that additional sensors 86 and 88 responsive to the angular position of the shaft and identified respectively as "front tail start" and "rear tail start" have connected output lines 90 and 92. The lines 90 and 92 extend to an OR gate 94 as does the line 60*a* from the sensor 58*a* for "end position start". A line 96 from the OR gate 94, which may be of conventional construction, extends to a "forward drive" bistable device 62*a* for alternative forward drive operation of the servo motor by the three sensors 58*a*, 86 and 88. The aforementioned line 32*a* from the sensor 30*a* extends to a second OR gate 98, which may also be of conventional construction and an output line 100 from the OR gate 98 extends to the "off" input of the bistable device 62*a*. Further, a line 102 from a junction 104 with the line 32*a* extends to a third OR gate 106 in turn having an output line 108 to an "on " input of a second or "reverse drive" bistable device 110 which may be substantially identical with the aforementioned devices 62,62*a* serving to maintain an "on " condition until an "off" signal is received and vice versa. An output line 112 from the bistable device 110 extends to the amplifier 36*a*.

Three similar sensors 114, 116 and 118 respectively provide for operation to "stop front tail", "stop rear tail" and "index". The sensors 114, 116 and 118 are responsive to the output of the servo motor and speed reducer 34*a* and may be of the magnetic type mentioned above in connection with sensors 58*a*, 86 and 88. A line 120 extending from the sensor 114 leads to the OR network 98 while the sensor 116 has an output line 122 to a junction 124 and thence to the OR network 98. A second line 126 from the junction 124 leads to the OR gate 106 and thence to the "on" side of the bistable device 110 through line 108. Output line 128 from the sensor 118 extends to the "off" side of the bistable device 110 for termination of reverse drive operation.

Figure 4:
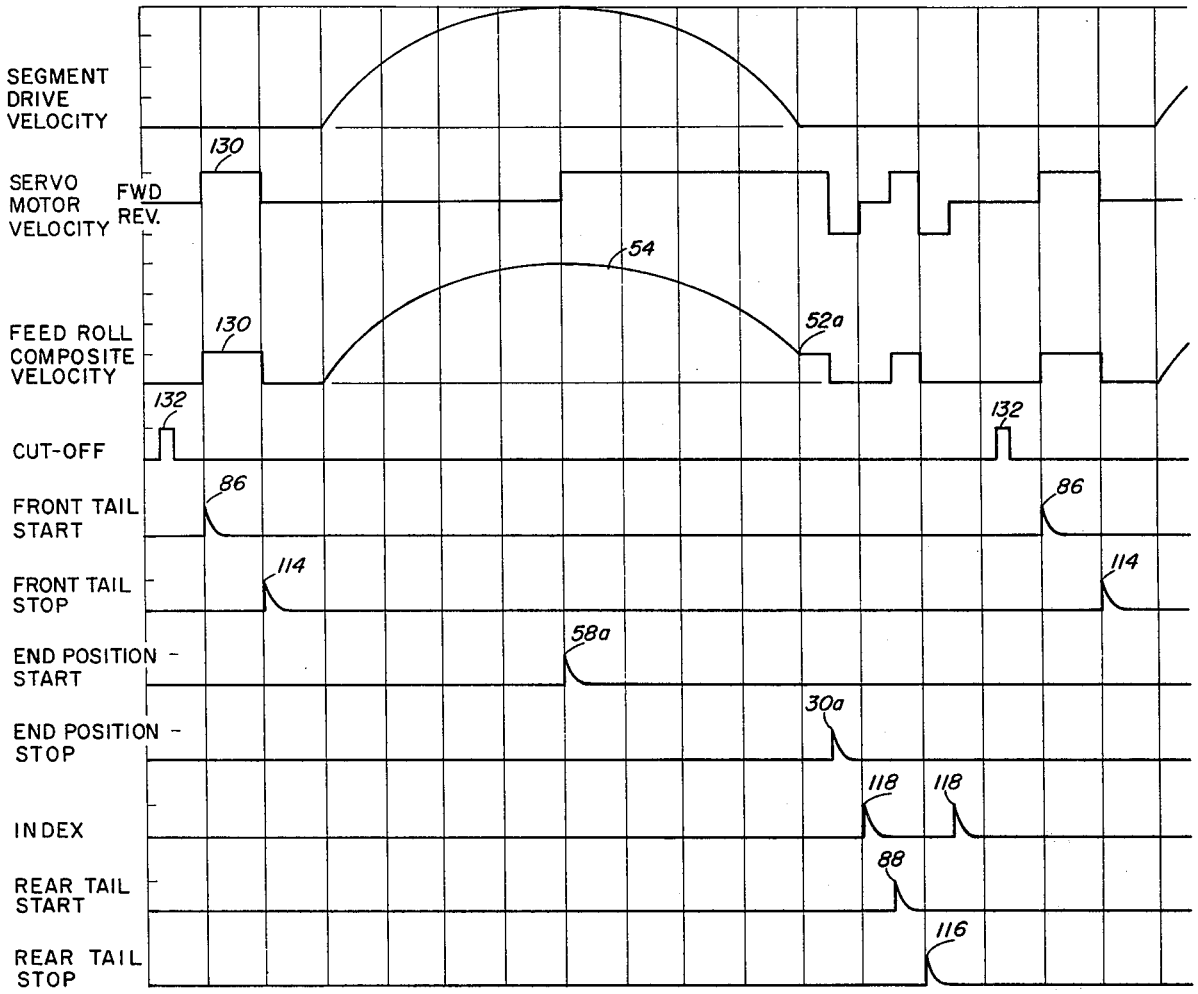
FIG. 4 is a timing diagram for the machine and auxiliary drive and control in its tail positioning and torsion spring formation mode of operation.

Referring now particularly to the timing diagram of FIG. 4, it will be observed that a leading or front tail of a torsion spring may be formed by servo motor feed operation initiated by the sensor 86, the signal being transmitted therefrom through line 90, OR gate 94, line 96 to the "forward drive" bistable device "on" connection and thence through the line 64*a* to the amplifier 36*a* and the servo motor 34*a*. The duration of a front tail wire feed operation 130 is of course determined by the relative positioning of the sensor 86 and the front tail stop sensor 114 on the output of the servo motor and speed reducer 30*a*. As will be apparent, the sensor 114 will operate through its output line 120, OR gate 98, and line 100 to introduce an "off" signal to the bistable device 62*a* when the desired length of wire has been fed for front tail formation. During the feeding operation for front tail formation, the coiling tool 16*a* is of course maintained in an inactive position by the aforementioned tool positioning mechanism under the control of camshaft 22*a*.

On completion of front tail formation the coiling tool is moved to its active position as shown for commencement of the formation of the main body of the spring. The harmonic velocity characteristic 54 is provided by the main feed 20*a* and at approximately the mid-point of main feed operation the sensor 58*a* operates to start servo motor operation through the line 60*a*, OR gate 94, line 96 and bistable device 62*a*. When the velocity of the main coiler drive drops off as at the junction 52*a* the servo motor takes over as above and termination of servo motor operation is accomplished by the sensor 30*a*, line 32*a*, OR gate 98, line 100, and the bistable device 62*a*. Concurrently, the signal from the sensor 30*a* is transmitted through line 102 to OR gate 106 and through line 108 to the "on" input in bistable device 110 whereby to initiate reverse driving operation of the servo motor and to index the motor to a desired "zero" or "start" position. When the desired angular position of the servo motor has been reached the index sensor 118 operates through line 128 and bistable device 110 to terminate reverse drive operation of the motor. With the precise termination of servo motor feed, the front tail 80 is positioned with accuracy and rear tail formation may now commence. The coiling tool is moved to its inactive position and sensor 88 serves to initiate rear tail formation through its output line 92, OR gate 94, line 96 and bistable device 62*a*. On completion of the desired rear tail formation sensor 116, through its output line 122, OR gate 98, and line 100 signals the bistable device 62*a* to terminate forward drive. Simultaneously, and through line 126 and OR gate 106 the bistable device 100 is signalled to initiate a reverse drive for a second indexing operation. When indexing is complete, sensor 118 through line 128 transmits an "off" signal to the bistable device 110 whereby to complete a cycle of operation and to arm the machine and auxiliary drive and control for a succeeding cycle of operation. Following the operation of the cut-off tool as illustrated by pulse 132 such succeeding cycle of operation occurs.

As will be apparent from the foregoing, a relatively simple and yet highly effective auxiliary drive and control has been provided for precise end positioning resulting in a high degree of accuracy in end relationship, for precise tail positioning, accurate angular relationship between leading and trailing tails in a torsion type coil spring, and for a high degree of accuracy in the generation of such tails.

We claim:

1. In a spring coiling machine, the combination of at least one pair of feed rolls for longitudinally advancing wire to a coiling station, at least one coiling tool at said station arranged to engage said longitudinally advanced wire and to obstruct feed movement thereof whereby progressively to bend the same to a coil spring configuration, a main drive means for said feed rolls operable to rotate said rolls whereby to advance a length of wire an increment less than that required for a coil spring of predetermined configuration and dimensions, fast response auxiliary drive means comprising an electrically operable servo motor and speed reducing means for said feed rolls operable to advance a final increment of wire for said predetermined coil spring, clutch means between said feed rolls and said main and auxiliary drive means operable to render effective the higher of two input rotational velocities from said main and auxiliary drive means, the latter drive means thus rotating the feed rolls for feeding said final increment of wire when the rotational velocity of said main drive means drops below that of the auxiliary drive means, and an auxiliary drive control including means operable during the rotation of said feed rolls by said main drive means to actuate said servo motor, said control also including means responsive to the position of a leading end portion of the wire in a spring formed at said coiling station, and said control being operable when said leading end portion reaches a predetermined position to terminate wire feeding operation of said auxiliary drive means and feed rolls.

2. The combination in a spring coiling machine as set forth in claim 1 wherein said machine is of the cyclically operable type and said main drive means is of the segment type and exhibits a harmonic velocity characteristic during each of its wire feeding movements, and wherein said servo motor and speed reducing means have a substantially constant velocity characteristic of a magnitude somewhat less than the maximum velocity attained by said main segment type drive, said clutch means thus operating during a velocity decreasing phase of each segment wire feeding movement to render the same ineffective and to render said servo motor effective to rotate said feed rolls for said final increment of wire feed.

3. The combination in a spring coiling machine as set forth in Claim 2 wherein said machine is of the cyclically operable type with a single main drive and a single auxiliary drive wire feeding operation occurring during each cycle of machine operation, and wherein said auxiliary drive control includes means for starting said servo motor once during each cycle of machine operation, said last mentioned means being operable when said segment rotational velocity received at said clutch means is greater than said reduced servo motor rotational velocity.

4. The combination in a spring coiling machine as set forth in claim 2 wherein said coiling machine includes a cam shaft operating in timed relationship with said segment drive, and wherein said means for starting said servo motor takes the form of a sensor responsive to angular position of said cam shaft and segment and operable to effect the aforesaid servo motor starting operation when a wire feeding movement of said segment is approximately one half complete.

5. The combination in a spring coiling machine as set forth in claim 1 wherein said position responsive means in said auxiliary drive control takes the form of a sensor of the optical type arranged to detect a preselected angular position of a leading end portion of a coil spring as said end portion follows a circular path during spring formation.

6. The combination in a spring coiling machine as set forth in claim 1 wherein said position responsive means in said auxiliary drive control takes the form of a sensor of the optical type arranged to detect a front tail of a torsion coil spring as said tail is swung angularly about during spring formation.

7. The combination in a spring coiling machine as set forth in claim 1 wherein said clutch means is unidirectional, and wherein said position responsive means in said auxiliary drive control operates to reverse said servo motor.

8. The combination in a spring coiling machine as set forth in claim 5 wherein said auxiliary drive control includes a bistable device for maintaining an "on" signal to said servo motor from said starting means until said position responsive means transmits an "off" signal thereto.

9. The combination in a spring coiling machine as set forth in claim 1 wherein said coiling tool is movable between active and inactive positions respectively for coiling and for the formation of torsion spring tails during longitudinal wire advancement, and wherein said auxiliary drive control includes means for starting and stopping said servo motor with said coiling tool in an inactive position whereby to form at least one tail on a torsion coil spring.

10. The combination in a spring coiling machine as set forth in claim 9 wherein said coiling machine includes a cam shaft operating in timed relationship with said main drive means, and wherein said means for starting said servo motor with said coiling tool inactive takes the form of a sensor responsive to angular position of said cam shaft.

11. The combination in a spring coiling machine as set forth in claim 10 wherein said means for stopping said servo motor on formation of a tail of a torsion coil spring takes the form of a sensor responsive to servo motor and speed reducer output.

12. The combination in a spring coiling machine as set forth in claim 9 wherein means is provided in said auxiliary drive control for indexing said servo motor to a "zero" or "start" position.

13. The combination in a spring coiling machine as set forth in claim 12 wherein said auxiliary drive control includes first and second bistable devices each operative to maintain "on" signals until "off" signals are received and respectively operative to effect forward and reverse driving operation of said servo motor, and wherein said indexing means includes said sensor responsive to servo motor and speed reducer output and an index sensor also responsive to servo motor and speed reducer output, said reverse drive bistable device being connected with and actuated by said two sensors sequentially whereby to reverse drive said servo motor to said "zero" or "start" position.

14. The combination in a spring coiling machine as set forth in claim 13 wherein said means responsive to the position of a leading end portion of the wire in a spring at said coiling station is connected with each of said bistable devices respectively to stop and start said forward and reverse drive devices, and wherein said index sensor serves to stop reverse driving operation as aforesaid at said "zero" or "start" position of said servo motor.

15. The combination in a spring coiling machine as set forth in claim 14 wherein said starting means and stopping means for tail formation each comprise a pair of sensors, the two starting sensors on the cam shaft each being connected with said forward drive bistable device to start said servo motor and respectively being adapted for front and rear tail formation, and the two sensors responsive to servo motor and speed reducer output each being connected with said forward drive bistable device to stop said servo motor and respectively being adapted for front and rear tail formation.

* * * * *